US005214254A

United States Patent [19]

Sheehan

[11] Patent Number: 5,214,254

[45] Date of Patent: May 25, 1993

[54] TRIPLE CONE EXHAUST WAVE TUNER

[76] Inventor: Russell T. Sheehan, 2853 Frembes, Waterford, Mich. 48329

[21] Appl. No.: 854,357

[22] Filed: Mar. 20, 1992

[51] Int. Cl.[5] ..... F01N 7/18

[52] U.S. Cl. ..... 181/241; 181/249; 181/255

[58] Field of Search ..... 181/249, 255, 258, 262, 181/263, 265, 274, 282, 271

[56] References Cited

U.S. PATENT DOCUMENTS 2,083,840 6/1937 Haas ..... 181/255

2,103,810 12/1937 Caspar ..... 181/255

FOREIGN PATENT DOCUMENTS 3415 of 1903 United Kingdom ..... 181/265

*Primary Examiner*—Michael L. Gellner
*Assistant Examiner*—Khanh Dang

[57] ABSTRACT

A triple cone exhaust wave and flow tuner for controlling the flow of exhaust gases and altering the resonant wave frequency generated by thee exhaust pulses including a reverse cone megaphone shaped enclosure, a perforated guide sleeve, and a rotatable, slidable perforated tuning pipe having a conical end.

2 Claims, 1 Drawing Sheet

TRIPLE CONE EXHAUST WAVE TUNER

BACKGROUND ART

The exhaust control devices commercially available, approach the gas flow control problem by offering appropriate sized units that are not adjustable, and offer no means of scavenging exhaust gases by adjustable resonance wave tuning. Flow rate and noise (decibel) control are coupled with one adjustment, thus when noise is reduced so is the flow rate.

SUMMARY

The triple cone exhaust wave and flow tuner is an apparatus consisting of a reverse cone megaphone shaped enclosure with an inlet and outlet at opposing ends for exhaust gases from an internal combustion engine to flow through. A tubular, perforated sleeve, which is located at the outlet end of the enclosure, provides a concentric guide and one half of the flow valve. The tuning pipe, which is tubular, perforated, and conical at the inlet flow end, provides the second half of the flow valve, which when rotated within the sleeve, allows alignment of the perforations to be varied for flow control of exhaust gases passing through the reverse cone megaphone enclosure.

Sliding the tuning pipe within the sleeve, longitudinally, the proximity of the conical shape of the inlet end of the tuning pipe to the inner megaphone surface is varied and provides a method of altering the resonant wave frequency generated by the exhaust cycle of the internal combustion engine.

DETAILED DESCRIPTION OF THE INVENTION

Figure 1:
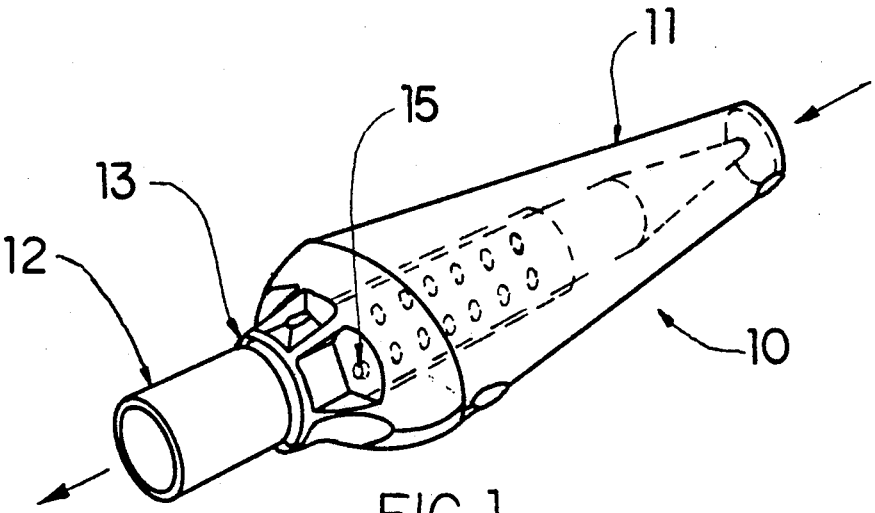
FIG. 1 is a perspective view of the triple cone exhaust wave and flow tuner.

FIG. 1 shows a triple cone exhaust wave and flow tuner device generally designated as 10, with the tubular perforated sleeve 13 and tubular perforated tuning pipe with conical shaped end 12, installed into the reverse cone megaphone shaped enclosure 11, of which the inlet and outlet is at opposing ends.

Figure 2:
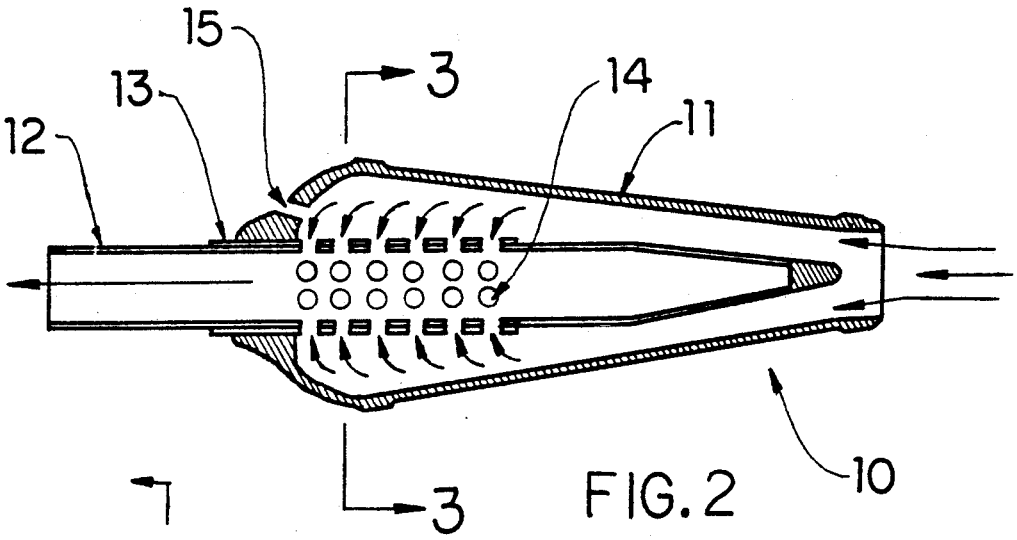
FIG. 2 is a diagramatic sectional view taken along the centerline of the apparatus.

FIG. 2 shows the flow of exhaust gases through device 10, from the inlet opening, around the conical shaped end of the tuning pipe 12, and venting through orifices 14 located in both tuning pipe 12, and in sleeve 13.

Figure 3:
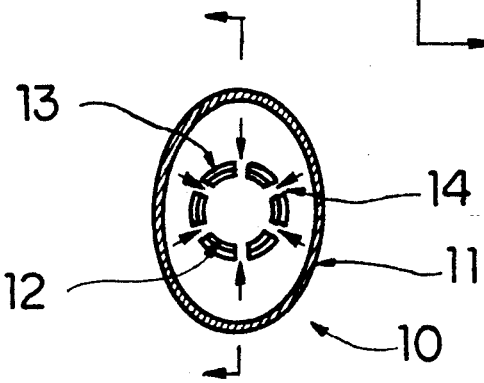
FIG. 3 is a diagramatic cross sectional view taken along the line 3—3 in FIG. 2, showing the related assembly of the perforated tubular sleeve, and the perforated tuning pipe.

FIG. 3 shows the flow of exhaust gases from the internal cavity of the reverse cone megaphone shaped enclosure 11, through aligned orifices of sleeve 13 and tuning pipe 12. When the tuning pipe 12 is rotated within sleeve 13 to misalign orifices 14, the flow of exhaust gas is restricted, which in turn is measured in the form of pressure at gauge orifices 15, which is located in the reverse cone megaphone shaped enclosure 11.

What I claim is:

1. A triple cone exhaust wave and flow tuner comprising:

a reverse cone megaphone shaped enclosure having an inside wall and inlet and outlet openings at opposite ends, a gauge orifice formed on said enclosure for monitoring a flow rate of exhaust gases, a tubular guide sleeve having a plurality of perforations thereon disposed inside said enclosure with one end connected to said outlet opening of said enclosure, a rotatable and slidable tubular tuning pipe having a plurality of perforations thereon; said tuning pipe having one closed end disposed inside said enclosure and another open end rotatable inside said guide sleeve in such a way that the perforations of said guide sleeve and the perforations of said tuning pipe may be placed in alignment; wherein the flow of exhaust gases from said inlet opening to said outlet opening can be adjusted by movement of said tuning pipe within said guide sleeve pipe to vary the alignment of said perforations.

2. The invention as claimed is claim 1, wherein said closed end of said tuning pipe is conical and the resonant frequency of exhaust pulses can be altered by longitudinally sliding said tuning pipe to vary the proximity of said conical end of said tuning pipe and said inner wall of said enclosure.

* * * * *